US006688345B1

(12) United States Patent
Iglesias et al.

(10) Patent No.: US 6,688,345 B1
(45) Date of Patent: Feb. 10, 2004

(54) METHOD AND DEVICE FOR DENSIFYING PULVERIZED MATERIAL

(75) Inventors: Joan Iglesias, Palau de Plegamans (ES); Josep Arisa, Barcelona (ES)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 0 days.

(21) Appl. No.: 10/069,903

(22) Filed: Aug. 6, 2002

(30) Foreign Application Priority Data

Aug. 23, 1999 (EP) ..... 991161704

(51) Int. Cl.[7] ..... B65B 1/04
(52) U.S. Cl. ..... 141/256; 141/286; 141/47
(58) Field of Search ..... 141/256, 286, 141/39, 47, 44, 93, 12, 71, 72; 222/412, 413, 152, 436

(56) References Cited

U.S. PATENT DOCUMENTS 3,664,385 A * 5/1972 Carter ..... 141/12
3,788,368 A 1/1974 Geng et al. ..... 141/67
4,185,669 A * 1/1980 Jevakohoff ..... 141/59
5,538,053 A 7/1996 Derby ..... 141/71
5,894,871 A 4/1999 Greer ..... 141/231
6,102,088 A * 8/2000 Wegman ..... 141/286

FOREIGN PATENT DOCUMENTS

| | | |
|---|---|---|
| CH | 533537 | 2/1973 |
| DE | 2260464 | 6/1973 |
| EP | 0125585 | 11/1984 |
| GB | 668394 | 3/1952 |
| GB | 2034591 | 6/1980 |

OTHER PUBLICATIONS

Derwent Abstr. 1975–D3320W [13] for IT 3589 A–71 (1971) which is the priority document for DE 2260464.

* cited by examiner

*Primary Examiner*—Steven O. Douglas
(74) *Attorney, Agent, or Firm*—Tyler A. Stevenson; David A. Crichton

(57) ABSTRACT

Method and device for densifying pulverized material, which is transported by means of a feeding screw in a screw housing, wherein alternatively vacuum and compressed air is applied via a filter on the inner circumference of the screw housing.

18 Claims, 8 Drawing Sheets

D - D

VIEW A

TOP VIEW C - C

METHOD AND DEVICE FOR DENSIFYING PULVERIZED MATERIAL

The invention relates to a method according to the preamble of claim 1 and a device according to the preamble of claim 3 for densifying and compacting pulverized or powdered material.

Such a method and device is disclosed in U.S. Pat. No. 3,664,385 A, which describes a method and an apparatus for feeding and compacting finally divided particulate material by means of a rotating screw feeder disposed in a tubular sleeve with a plurality of perforations. The sleeve is surrounded by a housing in such a way that at least one closed hollow chamber is provided extending about the sleeve. A mesh screen having smaller mesh openings than the size of the particles in the transported material is disposed to the exterior surface of the sleeve. A suction pressure is applied along the exterior of the foraminous sleeve to withdraw air from between the particles of the material, and intermittently a gas pressure is applied along the foraminous sleeve to back-flush material from the perforations to prevent clogging thereof.

EP 0 125 585 A discloses an equipment for the removal of air out of pulveruent materials comprising a packaging vessel having at a distance from the exterior wall a porous lining material substantially over the entire length of the packaging vessel through which lining material it is possible to remove air out of the packaging vessel or to feed pressurised air into the packaging vessel through the space between the exterior wall and the porous lining material. The space between the exterior wall and of the lining material is divided air-tightly in the direction of progress of the pulverulent material by means of partition wall, wherein a suction or pressure can be applied to each of the compartments independently from each other.

It is also known to densify pulverized material between two pressing rollers, wherein the pulverized material is pressed into the roller gap by means of, for example, two feeding screws arranged in parallel beside each other and disposed rotatably in a housing, into which the pulverized material is filled via a filling hopper under the effect of gravity. Gas or air contained in the pulverized material has a disturbing effect and can deteriorate the densifying operation between the two pressing rollers.

To remove air contained in the pulverized material before entering into the roller gap, it is known to provide a filter in the screw housing on a peripheral portion of the feeding screws via which filter vacuum can be applied.

It is the object of the invention to increase the efficiency of such a device for densifying pulverized material.

This object is achieved according to the invention by the features in the characterising part of claims 1 and 3 as well as by the features of claim 6.

The invention is described in more detail by way of an example in connection with the drawings.

Figure 1:
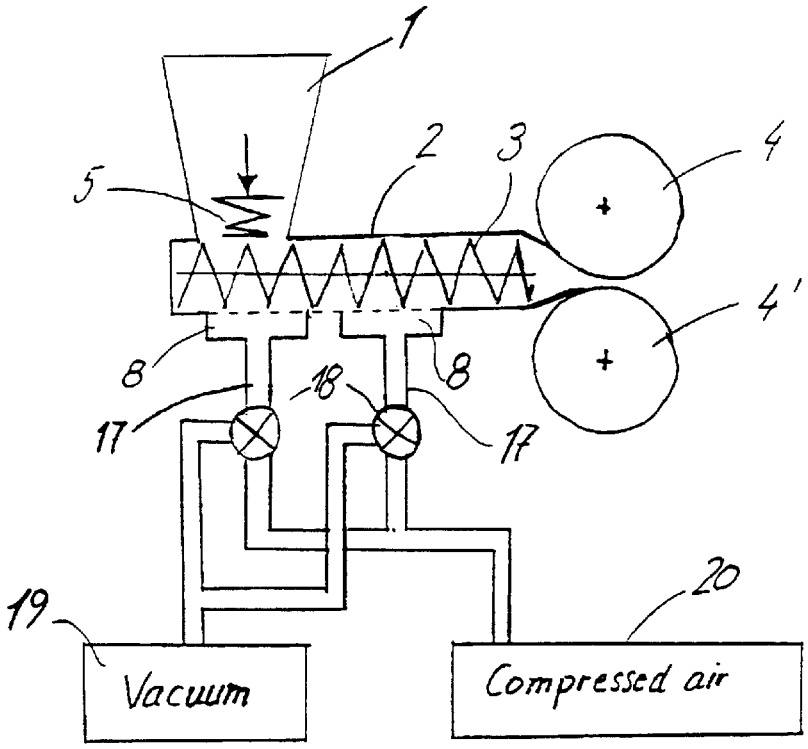
Figure 4:
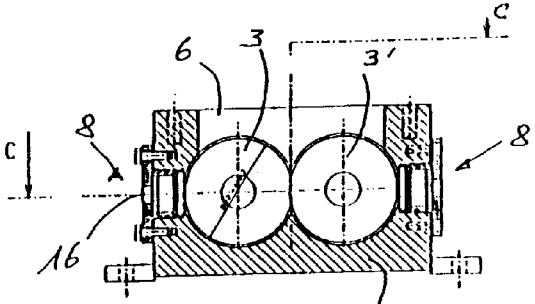
Figure 3:
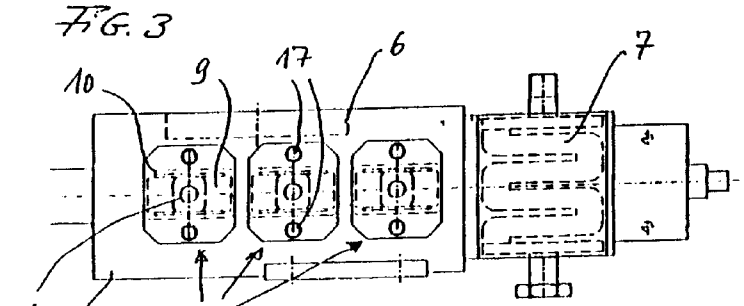
Figure 2:
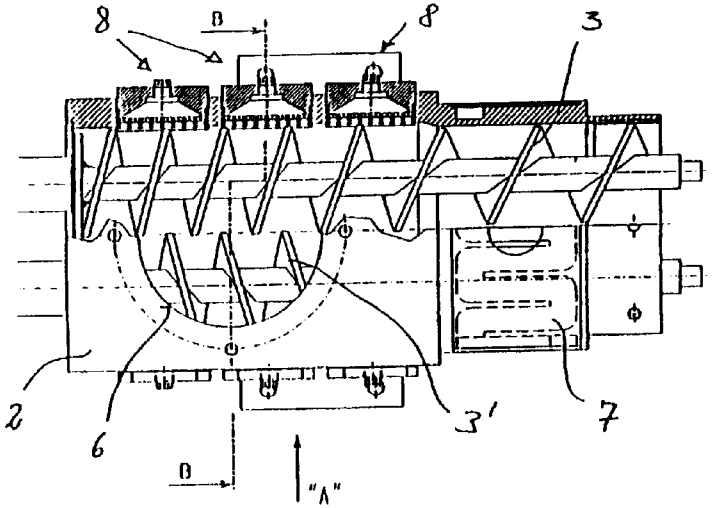
Figure 5:
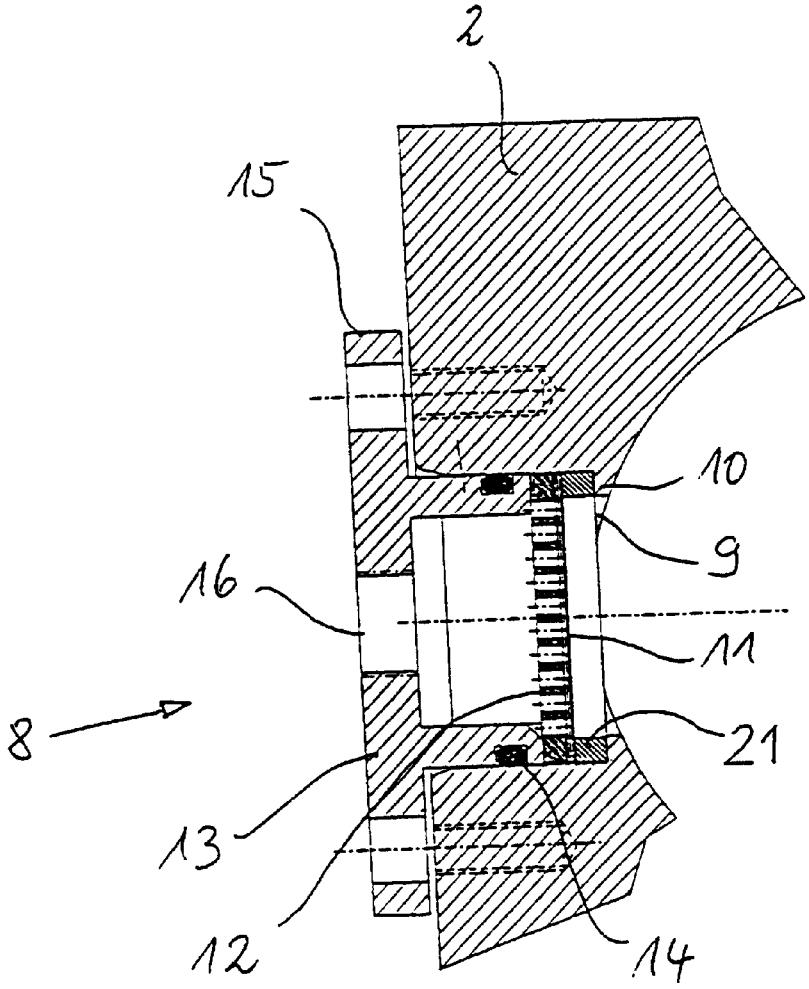
Figure 6:
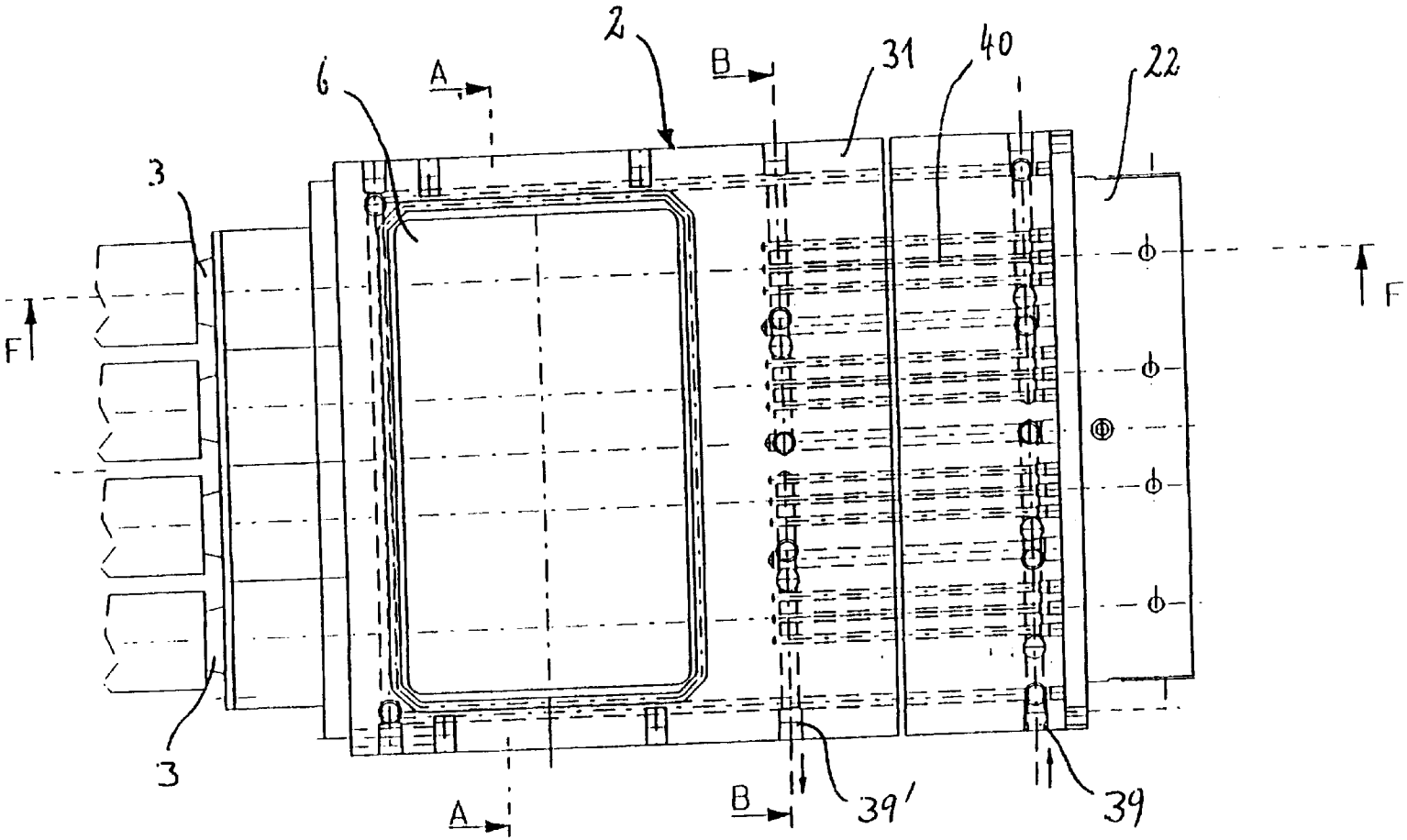
Figure 7:
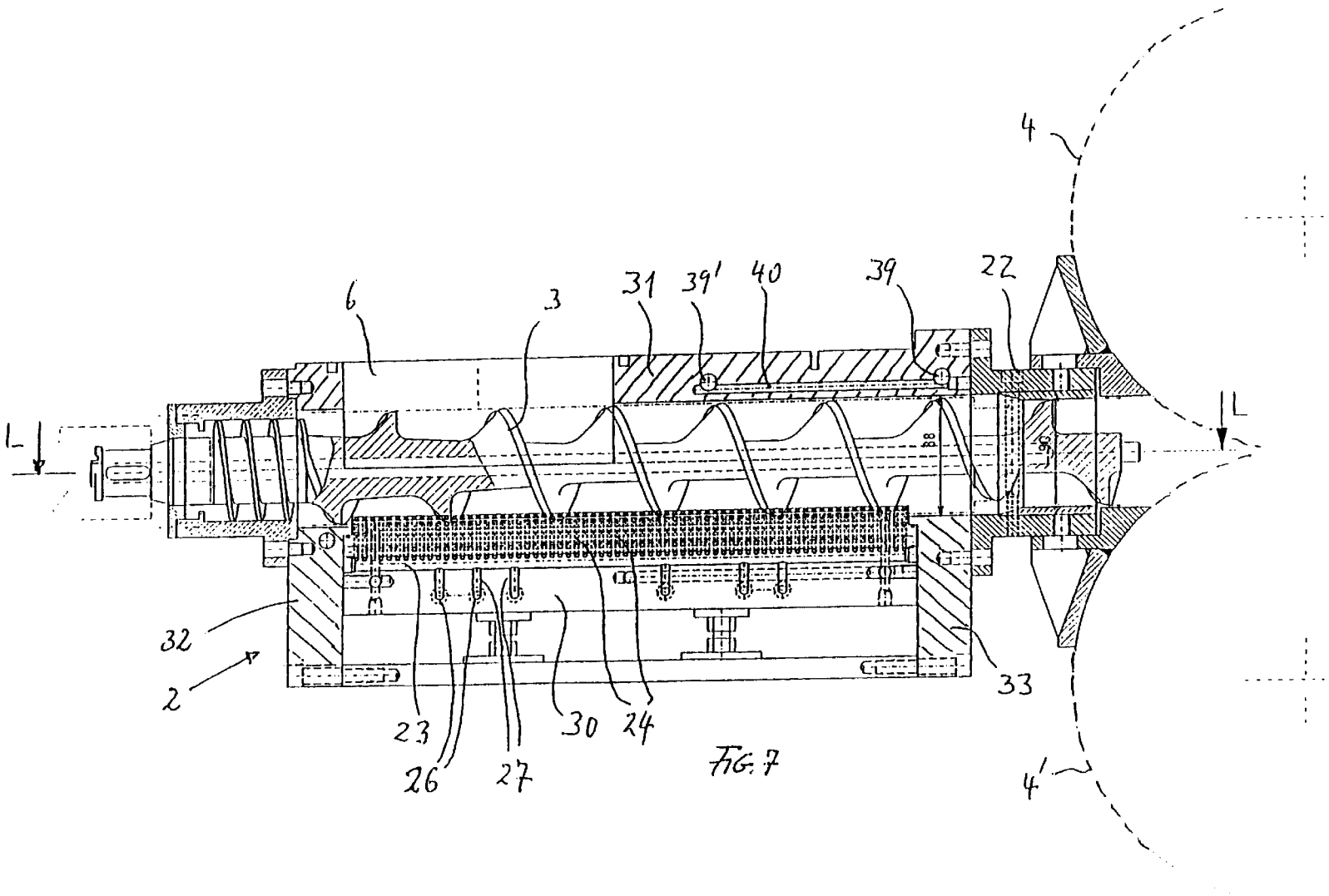
Figure 8:
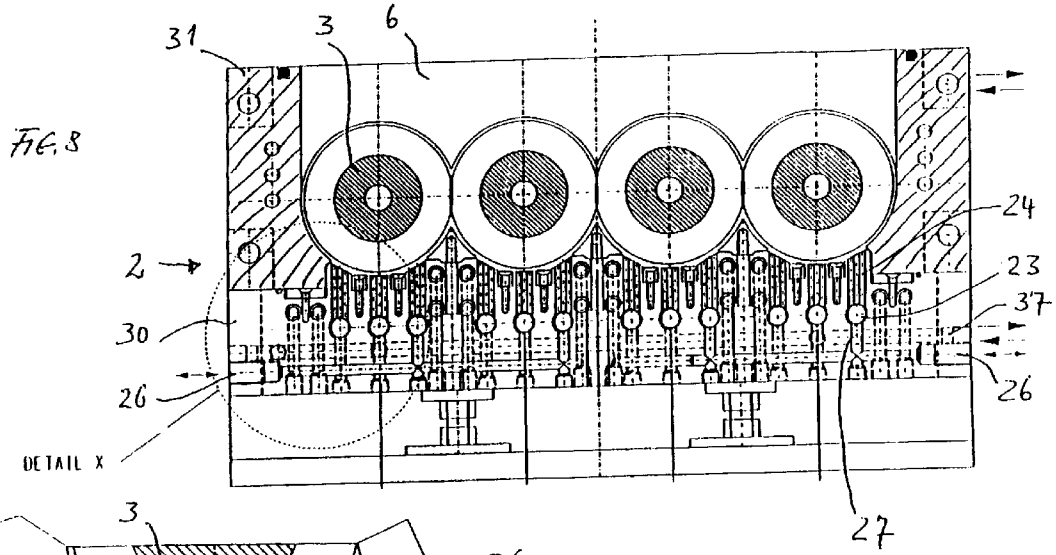
Figure 11:
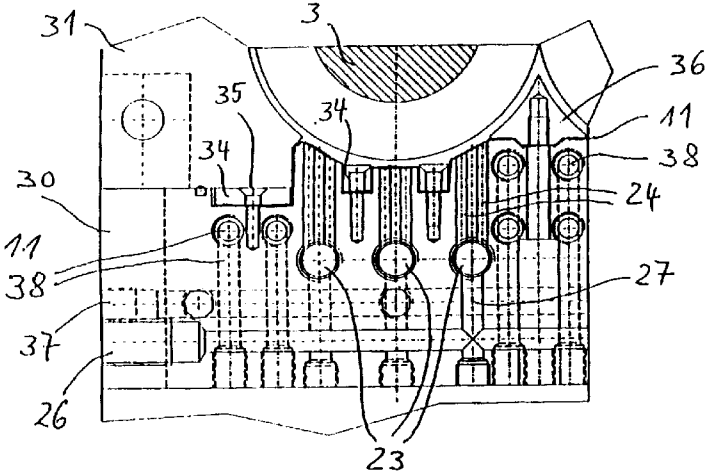
Figure 9:
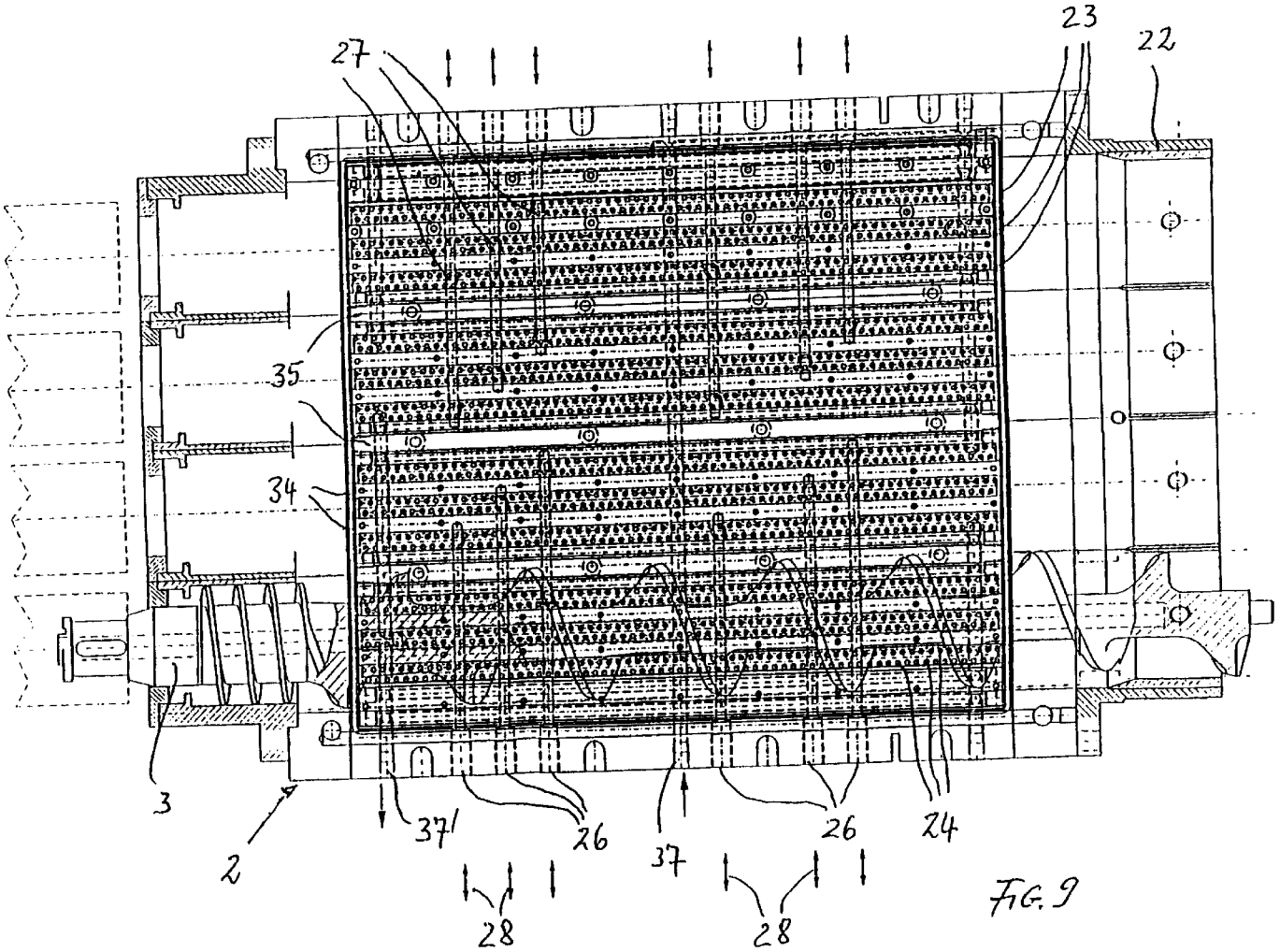
Figure 10:
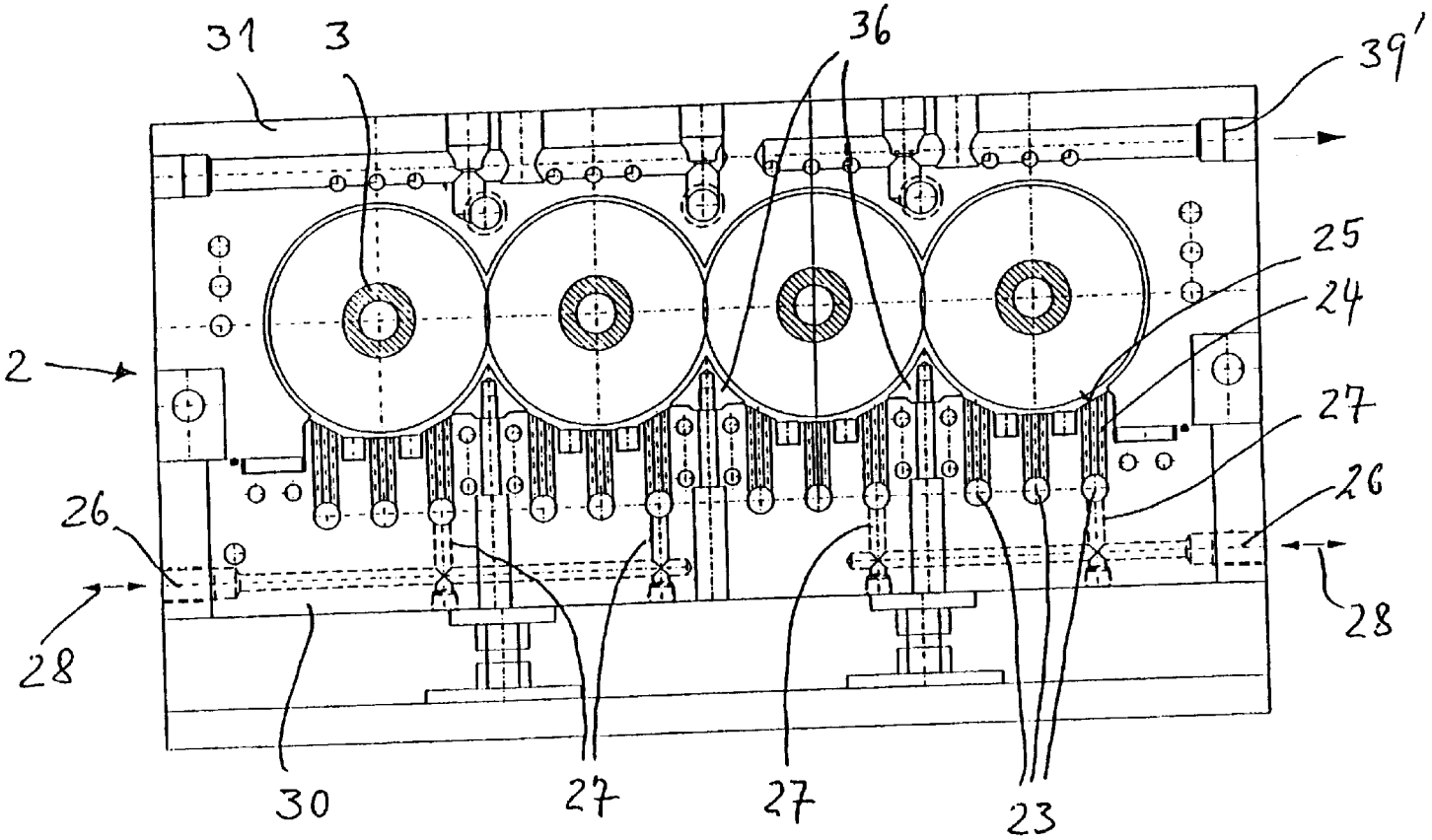

FIG. 1 shows schematically in a side view an assembly for densifying pulverized material, FIG. 2 is a top view in direction of the arrow C in FIG. 4 on the feeding screws, wherein the housing is partly broken away, FIG. 3 is a side view in direction of the arrow A in FIG. 2, FIG. 4 a cross sectional view along the line B—B in FIG. 2, FIG. 5 an increased cross-sectional view corresponding to FIG. 4, FIG. 6 a top view of a preferred embodiment, FIG. 7 a longitudinal sectional view along line F—F in FIG. 6, FIG. 8 a cross sectional view along line A—A in FIG. 6, FIG. 9 a cross sectional view along line L—L in FIG. 7, FIG. 10 a cross sectional view along line B—B in FIG. 6, and FIG. 11 shows the detail X in FIG. 8 in a larger scale.

FIG. 1 shows schematically an assembly for densifying pulverized material comprising a vertically disposed filling hopper 1, which is positioned over an inlet opening of a horizontally arranged screw housing 2, in which a feeding screw 3 is rotatably disposed. On the outlet of the screw housing opposite pressing rollers 4 and 4' are disposed, between which the pulverized material fed by the feeding screw 3 into the roller gap is compressed and densified. In the filling hopper 1 a stirrer 5 can be arranged which assists the filling of the pulverized material from the filling hopper 1 into the screw housing under the effect of gravity. Such an assembly is, for example, used for producing granulate from pulverized material, wherein further means which can be installed before the hopper 1 and after the roller pair 4, 4', are omitted in FIG. 1.

As an example two chambers 8 are formed in the screw housing, each of which is connected via a line 17 with a switch means 18 which is arranged between a vacuum source 19 and a pressure air source 20. In this way it is possible to apply vacuum to one of the chambers 8, while compressed air or pressure air is applied to the other chamber 8 and vice versa.

In FIG. 1 only one screw is shown in the screw housing 2, however, also a plurality of screws can be arranged beside each other for increasing the feeding capacity. FIG. 2 shows an example with two feeding screws 3 and 3' disposed in parallel beside each other, which are rotatably disposed in the screw housing. An inlet opening 6 is provided on the upper side of the screw housing 2 in FIGS. 2 to 4. Above of this inlet opening 6 the hopper 1 is arranged, wherein the inlet opening 6 essentially extends over the width of the two screws 3 arranged beside each other, as FIG. 4 shows.

In the example of an embodiment shown in FIGS. 2 to 5 on the opposite sides of the screw housing 2 three chambers 8 are provided each spaced from each other along the feedway. The chambers 8 have, for example, a rectangular form, wherein the long side of the rectangle extends in direction of the longitudinal axis of the feeding screws. On the transition between chamber 8 and inner circumference of the screw housing 2 an about rectangular connection opening 9 is provided as it is shown in FIG. 3 by dotted lines. This connection opening 9 is surrounded by a shoulder 10 of the housing 2, which shoulder forms a frame-like surface for abutting of a plate-like filter 11, which, for example, can consist of a sintered material or a filter fleece. In FIG. 5 a ring element 21 is provided between shoulder 10 and filter 11 for supporting the filter. Such a ring element 21 can be replaced by a perforated plate for supporting the filter 11 on the inner side when pressure air is supplied. The filter 11 is supported on the outer side by a perforated plate 12 which is held by an insert 13 in the chamber 8. The tubus-shaped part of the insert 13 projecting into the chamber 8 is provided on the outer circumference with a sealing ring 14, by which the chamber 8 is sealed relative to the outside. On the closed outer side of the insert 13 a connection opening 16 is formed as well as a flange 15, by means of which the insert 13 is fastened gas-tight, for example, by means of screws on the screw housing 2.

During operation, alternatingly vacuum and compressed air is applied via the connecting opening 16 on the chambers 8 arranged one after the other in feeding direction. The pulverized material transported by the feeding screws 3 is deaerated via the filter 11 by the applied vacuum, whereas by means of compressed air the filter is cleaned and the pulverized material in the screw feeder is compressed.

The amount of vacuum and the intervals of application of vacuum and compressed air can be varied, whereby the degree of deaeration can be adapted to the kind of pulverized material used. Likewise, the sequence of applying vacuum and compressed air on the successive chambers can be varied. In an example, vacuum is applied on two chambers 8, whereas on the third chamber compressed air is applied.

By the alternating application of vacuum and compressed air on the chambers 8 a significantly higher densification or compacting efficiency on the pressing rollers is achieved, in relation to applying only vacuum, because the pulverized material is remarkably deaerated and pre-compressed with high efficiency in the screw feeder before arriving on the roller gap.

According to the invention, a high deaerating degree in combination with a small filter surface is achieved.

In the shown example the chambers 8 are arranged along the sides of the screw housing 2. It is, however, also possible to provide the chambers 8 on the underside of the screw housing 2. If, for example, three feeding screws are arranged beside each other in the screw housing 2, chambers can be provided in the area of the middle feeding screw on the underside of the housing 2, whereas the chambers 8 for the two outer feeding screws can be provided on the sides thereof or also on the underside of the housing 2.

Instead of the shown three chambers 8 also further chambers can be provided behind each other over the length of the feeding screws, corresponding to the length of the feedway. It is also possible to provide only one chamber 8 on the circumference of the feeding screw, on which chamber alternatingly vacuum and compressed air is applied. A higher efficiency is, however, achieved by a plurality of chambers arranged behind each other.

Vacuum and compressed air is applied synchronously on the chambers 8 provided on the same circumference of the screw housing 2. In this way, for example, the first chambers 8 in FIGS. 2 and 3 provide a zone within the feeder, wherein vacuum is applied, whereas the third chambers 8 provide a zone within the feeder, in which zone compressed air is applied. These zones are sealed against each other by the circumference of the feeding screws 3. The distance between the chambers 8 arranged behind each other in longitudinal direction is chosen such that dependent on the pitch of the feeding screw 3 no shortcut between neighboured chambers 8 occurs, if the one chamber is acted upon with compressed air and the neighboured chamber is acted upon with vacuum.

Preferably at least the first chamber 8 is provided immediately in the area of the inlet opening 6. In the shown example two chambers 8 are provided in the area of the inlet opening 6 as the diameter of the inlet opening extends over two chambers 8.

According to an embodiment of the invention, vacuum is applied over a longer period than compressed air. Further it is possible to apply vacuum as well as compressed air in the form of short pulses following each other.

In the embodiment comprising three chambers 8, for example, the first and second chambers can be acted upon by vacuum, whereas on the third chambers compressed air is applied. The alternating application of vacuum and compressed air to separate chambers 8 which are arranged in feeding direction one behind the other results in a higher precompression than if only one chamber 8 is applied, even if this chamber extends over the same feedway as several separate chambers 8 arranged at a distance from each other.

The feeding screws are provided with a portion of decreased diameter, as this can be seen from the plan view in FIG. 2, wherein in this area a cooling means 7 is arranged. The feeding screws can, however, also have the same diameter throughout.

FIGS. 6 to 11 show another preferred embodiment of a device according to the present invention, wherein same reference numerals are used for the same or corresponding elements.

According to this preferred embodiment channels 23 are provided along the longitudinal extension of a feeding screw 3 instead of chambers 8 so that perforations can be provided throughout the length of a feeding screw.

As an example the embodiment according to FIGS. 6 to 10 shows a device comprising four feeding screws 3 which are arranged in parallel to each other in a housing 2 of rectangular shape. In the top view of FIG. 6 a rectangular inlet opening 6 is provided on the upper side of the housing for connecting the housing 2 with a filling hopper 1 as shown in FIG. 1.

The longitudinal sectional view of FIG. 7 corresponds to the view in FIG. 1, wherein FIG. 7 shows in more detail a mouth piece 22 between housing 2 and pressing rollers 4, 4'.

On the lower side of the housing 2 opposite to the inlet opening 6 channels 23 are provided in the housing 2, which channels 23 extend essentially along the length of the housing 2. FIGS. 8 and 9 show three channels 23 which are arranged in parallel to each other in the area of a single feeding screw 3. Each channel 23 is connected with a plurality of small diameter bores 24 which extend between the channels 23 and the inner surface 25 of the housing 2 and correspond to the perforations in plate 12 of FIG. 5. In this embodiment two rows of bores 24 are provided along a single channel 23 as can be seen in FIG. 9.

For supplying vacuum and pressure air to the channels 23 ducts 26 are provided extending below of the channels 23 essentially perpendicular to these channels 23 in the lower part of the housing 2 as shown in FIG. 9. Vacuum and pressure air is supplied alternatingly to these ducts as indicated by arrows 28. Each duct 26 is connected with two channels 23 via vertical extending connecting bores 27. The ducts 26 have different length wherein the longest duct 26 extends up to the sixth channel 23 adjacent to the longitudinal center axis of the housing 2. A further duct 26 extends up to the fifth channel 23 from both sides of the housing 2 whereas the shortest duct 26 extends from the outside of the housing 2 up to the fourth channel 23 as shown in FIGS. 9 and 10.

In the shown embodiment six ducts 26 are provided on each side of the housing 2, wherein three ducts 26 of different length are provided each for a half of the longitudinal extension of a feeding screw 3. In this way each channel 23 is connected via two connecting bores 27 with two ducts 26. In this way vacuum and pressure air is supplied to all of the bores 24 of a channel 23 in an effective way.

The housing 2 is composed of at least four parts, a lower part 30 provided with channels 23 and ducts 26, an upper part 31 provided with the inlet opening 6 as well front and end parts 32, 33 as shown in FIG. 7. The inner surface 25 of the lower part 30 (FIG. 8) is provided with perforations in the form of the bores 24. A filter cloth 11 extends over these perforations or bores 24, respectively. Said filter cloth 11 is held under tension by means of fastening elements in the form of bars 34 extending along grooves in the lower housing part 30 between the channels 23 and on both sides of the lower housing part 30. Said bars 34 are fastened by means of screws 35 on housing part 30 and the filter cloth 11 is clamped between bars 34 and housing part 30. A bar 36 of essentially triangular cross-section is provided between the feeding screws 3 to fill the triangular space between adjacent feeding screws as shown in FIGS. 10 and 11. The filter cloth 11 is also clamped between this bar 36 and the housing part 30.

The plate-like lower housing part 30 is provided with cooling passages 37 for circulating of a cooling medium within the housing part 30. In this embodiment one passage 37 extends across the channels 23 for supplying cooling medium and a further passage 37' is provided for return flow. Between these passages 37 and 37' connecting passages 38 are provided which extend vertically and along the longitudinal axis of the lower housing part 30 as can be seen in FIG. 11.

In the upper part 31 of the housing corresponding passages 39 and 39' and connecting passages 40 for circulating of a cooling medium are provided as shown in FIGS. 6 and 10.

Despite of the fact that vacuum and compressed air are applied alternatingly over the length of the feeding screws 3 very high efficiency in densifying pulverized material is achieved by the embodiment according to FIGS. 6 to 10 due to the dense arrangement of channels 23 and perforations in the form of bores 24 all over the length of the feeding screws 3.

Instead of ducts 26 extending across the channels 23 ducts can also be provided in the front and end parts 32 and 33 of the housing for supplying vacuum and compressed air to the channels 23.

The described method of alternating application of vacuum and compressed air via a filter can be applied in various apparatuses for densifying and compacting pulverized material, for example, also in packaging assemblies, in which a high filling weight of the packing and a decrease of the pulver volume is important. Likewise, the method and the device according to the invention can be applied in side feeders of extruders for light and aerated pulvers and so on.

LIST OF REFERENCE NUMERALS

1 Filling hopper
2 Screw housing
3 Feeding screw
4 Pressing rollers
5 Stirrer
6 Inlet opening
7 Cooling means
8 Chamber
9 Connection opening
10 Shoulder
11 Filter
12 Plate
13 Insert
14 Sealing ring
15 Flange
16 Connecting opening
17 Line
18 Switch means
19 Vacuum source
20 Compressed air source
21 Ring element
22 Mouth piece
23 Channels
24 Bores
25 Inner surface
26 Ducts
27 Connecting bores
28 Arrows
29
30 Lower housing part
31 Upper housing part
32 Front part
33 End part
34 Bars
35 Bars
36 Screws
37 Passages
38 Connecting passage
39 Passage
40 Connecting passage

What is claimed is:

1. Method for desifying pulverised material, which is transported by means of a feeding screw (3) in a screw housing (2), wherein alternatingly vacuum and compressed air is applied via a filter (11) on the inner circumference of the screw housing (2), characterised in that a plurality of chambers (8) is provided behind each other over the length of the feed way, on which chambers (8) alternatingly vacuum and compressed air is applied during transport of the pulverized material by means of the feeding screw wherein vacuum and compressed air is applied alternatingly in such a way that vacuum is applied in one chamber, whereas simultaneously compressed air is applied on an adjacent chamber (8).

2. Method according to claim 1, wherein the amount of vacuum and the intervals of application of vacuum and compressed air are varied.

3. Device for densifying pulverised material, comprising at least one feeding screw (3) in a screw housing (2), wherein perforations are provided on a circumferential portion of the feeding screw in the screw housing, which perforations are covered by a filter (11), wherein the filter is connected via a line means (17) with a switching means (18) which is arranged between a vacuum source (19) and a compressed air source (20), characterised in that in longitudinal direction of the feeding screw at least two chambers (8) are provided at a distance from each other in the screw housing, in which chamber (8) a plate (12) provided with perforations is supported by an insert (13), on which plate (12) a plate-like filter (11) is arranged, and which chambers can be acted upon respectively via the switching means (18) alternatingly with vacuum and compressed air.

4. Device according to claim 3, wherein an insert (13) is provided in each chamber (8) which insert (13) is provided with a sealing ring (14).

5. Device according to claim 3, wherein the plate-like filter (11) abuts a shoulder (10) of the screw housing (2), which shoulder surrounds a connection opening (9).

6. Device for densifying pulverized material comprising a plurality of feeding screws (3) arranged parallel in a housing (2), wherein channels (23) extend in a distance from the feeding screws along the feeding screws (3) in the housing (2), and bores (24) extend between the channels (23) and an inner surface (25) of the housing, which bores (24) are provided along each channel (23) and wherein the bores (24) are covered by a filter cloth (11) on the inner surface (25) of the housing.

7. Device according to claim 6 wherein ducts (26) extend essentially perpendicular to the channels (23) in the housing (2), which ducts (26) are connected via connecting bores (27) with one of the channels (23) associated to one feeding screw (3).

8. Device according to claim 6, wherein the filter cloth (11) is fastened on the housing by means of fastening elements in the form of bars (34,36) provided between the rows of bores (24) along each channel (23).

9. Device according to claim 6, wherein the channels (23) are provided in a plane extending in a distance from the circumference of the feeding screws (3) which are arranged in parallel to each other in another plane.

10. Device according to claim 7, wherein the ducts (26) have different lengths.

11. Device according to claim 6, wherein each channel (23) is connected via two connecting bores (27) with two ducts (26) arranged in a distance along the feeding screws.

12. Device according to claim 7, wherein the filter cloth (11) is fastened on the housing by means of fastening elements in the form of bars (34,36) provided between the rows of bores (24) along each channel (23).

13. Device according to claim 7, wherein the channels (23) are provided in a plane extending in a distance from the circumference of the feeding screws (3) which are arranged in parallel to each other in another plane.

14. Device according to claim 8, wherein the channels (23) are provided in a plane extending in a distance from the circumference of the feeding screws (3) which are arranged in parallel to each other in another plane.

15. Device according to claim 7, wherein each channel (23) is connected via two connecting bores (27) with two ducts (26) arranged in a distance along the feeding screws.

16. Device according to claim 8, wherein each channel (23) is connected via two connecting bores (27) with two ducts (26) arranged in a distance along the feeding screws.

17. Device according to claim 9, wherein each channel (23) is connected via two connecting bores (27) with two ducts (26) arranged in a distance along the feeding screws.

18. Device according to claim 10, wherein each channel (23) is connected via two connecting bores (27) with two ducts (26) arranged in a distance along the feeding screws.

* * * * *